United States Patent [19]

Demartini

[11] 4,404,775

[45] Sep. 20, 1983

[54] RAIN GUTTER DEVICES

[76] Inventor: Robert J. Demartini, 3500 Canter La., Raleigh, N.C. 27604

[21] Appl. No.: 310,838

[22] Filed: Oct. 14, 1981

Related U.S. Application Data

[63] Continuation-in-part of Ser. No. 198,830, Oct. 20, 1980, abandoned.

[51] Int. Cl.[3] ..... EO4D 13/04

[52] U.S. Cl. ..... 52/12; 52/11; 210/162; 210/801; 405/119

[58] Field of Search ..... 52/11, 12; 405/119; 210/162, 801, 538, 532.1

[56] References Cited

U.S. PATENT DOCUMENTS

| | | | |
|---|---|---|---|
| 546,042 | 9/1895 | Van Horn | 52/12 |
| 603,611 | 5/1898 | Nye | 52/12 |
| 836,012 | 11/1906 | Cassen | 52/12 |
| 891,405 | 6/1908 | Cassen | 52/12 X |
| 1,101,047 | 6/1914 | Yates | 52/12 |
| 2,669,950 | 2/1954 | Bartholomew | 52/12 |
| 2,672,832 | 3/1954 | Goetz | 52/12 |
| 2,873,700 | 2/1959 | Heier | 52/12 |
| 3,248,827 | 5/1966 | Hardy | 52/11 |
| 3,388,555 | 6/1968 | Foster | 52/12 X |
| 3,507,396 | 4/1970 | Homa | 210/477 |
| 3,660,955 | 5/1972 | Simon | 52/303 X |
| 3,950,951 | 4/1976 | Zukauskas | 52/12 X |
| 4,198,043 | 4/1980 | Timbes et al. | 405/119 X |

FOREIGN PATENT DOCUMENTS

| | | | |
|---|---|---|---|
| 510773 | 11/1979 | Australia . | |
| 870332 | 12/1941 | France | 52/11 |

OTHER PUBLICATIONS

Monier Leafless Gutter System, Monier Limited Inc. Sydney, Australia, 4 pp.

Elko Gutta-Guard, Colonial Iron Works, 2010 Boulevard, Colonial Heights, Va. 23834, 2 pp.

*Primary Examiner*—Alfred C. Perham

*Attorney, Agent, or Firm*—William G. Rhines

[57] ABSTRACT

Embodiments useful as means for inhibiting the accumulation of leaves and other debris in household rain gutters. Embodiments include structures which comprise a deflector having a sloped portion, the top edge region of which is adapted for juxtapositioning to the roof shingles, and the bottom edge region of which is arcuate through a large radius cross-section. In such embodiments, the farthest outward extension is outside the outermost edge of the associated rain gutter and the lower edge is positioned between the edges of the rain gutter. Embodiments include means for attenuating the force of water and reducing the localized concentrating of water flowing thereover, such as longitudinal ridges and/or means for improving the surface wettability. Through practice of this device, kinetic gravity-induced forces on up to normal volumes of water flowing down the sloped portion may be kept, through the arcuate portion, below the forces acting counter-directionally thereto due to surface tension of the water normally to prevent substantially centripetal ejection of water as its direction of travel is changed to deposit it in the gutter while ejecting water carried debris carried outside the gutter.

41 Claims, 12 Drawing Figures

RAIN GUTTER DEVICES

CROSS REFERENCE TO OTHER APPLICATION

This is a Continuation-in-Part Application of application Ser. No. 198,830, filed Oct. 20, 1980 now abandoned.

BACKGROUND OF INVENTION

It is known in the construction industry, particularly the building of dwelling houses and other buildings, to erect a rain gutter at roof edges. Such gutters usually have associated downpipes. By these means, water coming off the roof may be intercepted, collected, and diverted into desired locations. This avoids splashing, "trenching", flooding, and other undesired effects. A persistent problem with such gutters is that they collect leaves, sticks, roof granules, pine needles, and other debris as well. This causes the gutters and/or downpipes to become blocked. As a result, water backs up, causing it to flood over the gutter edges and sometimes down the side of the building, and permitting freezing in the gutter to occur. It may also or alternatively cause the gutter to accumulate pools of water which do not drain off rapidly or readily, and cause weeping and/or rusting of joint areas and sometimes freeze into ice in cold weather. Additionally, gutters may become broken by snow and/or ice sliding off the associated roof.

In an attempt to overcome the necessity for manually clearing the gutters and/or down pipes periodically, usually by ascending a ladder, various proposals have been made. They range from applying screens to cover the gutter openings, to deflector means. The general experience has been that the installation of screens basically does little more than relocate the problem of debris blocking from the gutter to the screen, necessitating periodic manual removal anyway. From time to time, it has been proposed to use "deflector" type devices, by which it was contended it would be possible to redirect the flow of rainwater coming off of the top surface of a roof into a gutter, free of debris which will, in the meantime have been ejected off of the roof onto the ground. Some of such deflector type devices include a lower arcuate surface by which, theoretically, water coming down the roof will, by the effect of surface tension, be forced to follow around the arcuate surface. By this means, it was postulated that the water may be deposited in the gutter which is positioned inside and below the arcuate surface, while debris carried by the water is jettisoned off, more or less tangentially to the curved surface, and falls to the ground. In this connection, reference is made to the following U.S. Pat. Nos.: Van Horn 546,042; Nye 603,611; Cassen 836,012; Cassens 891,405; Yates 1,101,047, Goetz 2,672,832, Bartholomew 2,669,950; Heier 2,873,700; Natthews et al 2,935,954; Foster 3,388,555; Homa 3,507,396; and Zukauskas 3,950,951.

A remarkable thing about devices such as the foregoing is that although the basic theory has been available for some time, as far as is now known, it has never actually been adopted or used in what might reasonably be described as a commercial embodiment. In part, this may be because there is little to impell builder-contractors to incur whatever extra cost or expense involved in making such installation initially. Once a conventional system has been installed, to "retrofit" an existing installation involves troublesome, time-consuming, costly, basic and/or aesthetically undesirable structural alterations to the existing gutter installation and, in many cases, to the building with which it is associated. It also appears that a reason why the concept has not found significant or widespread use is because, as disclosed to date, it didn't work with a sufficient degree of reliability or effectiveness to make it practically feasible. That is, practicing the extant disclosures as taught, it has been found that surface tension of the water often is not sufficient to contain the water through an arcuate travel path against counter-forces typically encountered from factors such as a large volume of water, steep slopes, "rivuletting", etc. Whatever the particular reasons, the impressive fact is the lack of their adoption and use to date, in spite of the obvious advantages which might occur if they could be used, in light of the costs and difficulty of obtaining maintenance labor, particularly in recent times.

Accordingly, it is an object of the present invention to provide means for accomodating roof-water while segregating debris therefrom.

Another object of this invention is to provide such means in a form which is substantially maintenance free.

Still another object of this invention is to provide means for accomplishing some or all of the foregoing objectives in a form which is structurally simple and easy to install.

Yet another object of this invention is to provide means for accomplishing some or all of the foregoing objectives which is adapted for retrofitting existing installations.

SUMMARY OF INVENTION

Desired objectives may be achieved through practice of the present invention, embodiments of which include a rain gutter debris deflector for disassociating rain water from debris and depositing the rain water in an associated rain gutter while ejecting debris so that it does not pass into the rain gutter, characterized by having an upper sloped portion, a lower arcuate deflector portion for re-directing water through operation of surface tension, and means for controlling the normal flow of water through the arcuate portion so that centripetal forces thereon substantially throughout will not exceed the surface tension of the water.

DESCRIPTION OF DRAWINGS

This invention may be understood from the descriptions herein set forth and from the accompanying drawings in which.

DESCRIPTION OF PREFERRED EMBODIMENTS

Figure 1:
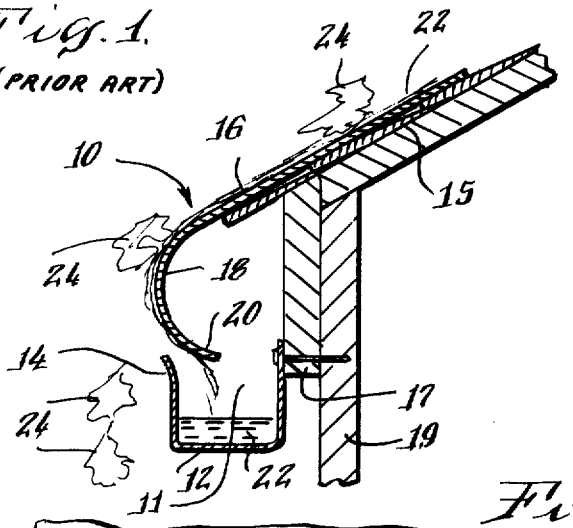
Fig. 1. (PRIOR ART)
FIG. 1 illustrates a prior art device.

Referring first to FIG. 1, there is depicted a prior art device 10, for use in connection with a known per se rain gutter 12, which has an outer edge lip 14. Normally, such rain gutters are positioned higher up on the fascia 17 of the building 19 than as shown in FIG. 1, so that the plane of the shingles 15 is intercepted by the lip 14 of the gutter 12, so that rain coming off the roof shingles 15 will be caught by the gutter 12.

Figure 2:
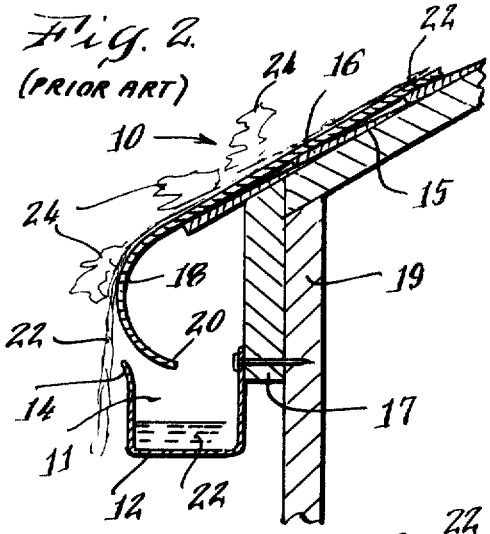
Fig. 2. (PRIOR ART)
FIG. 2 illustrates another prior art device.

It will be obvious from FIG. 1 that installation of the water deflection device 10 has made it necessary to lower the gutter 12. Even with a new installation, this presents some difficulties because the positioning of the gutter 12 and the device 10 must be carefully regulated with respect to the amount of overhang and angle of the roof 15. In a "retrofit", or installation of a water deflector 10 to an existing installation, the problem is even more difficult, because it involves the added problem of having to move and relocate installed gutters and downspouts. According to the prior art, a water deflection device 10 may be installed contiguous with the edge of the roof. It includes a flat main portion 16 and a curved or arcuate portion 18 between the main portion 16 and the lower edge 20. The device 10 is so positioned that the lower edge 20 is between the front edge 14 and the rear wall of the gutter 12, and the curved portion is of sufficiently large radius as to extend beyond the trough 11 portion of the gutter 12, and to cause water 22 traversing the device 10 to be caused, by surface tension, to follow around the curved portion 18 and leave the device 10 at the lower edge 20. While this is going on, leaves and other debris 24 being impelled along by the water 22, if not being subject to the same surface tension forces will tend to generate sufficient centripetal force to fly free of the water and jettison free of the device 10 without ending up in the gutter 12. FIG. 2 illustrates a result which occurs when the prior art teachings, without more, are followed. As illustrated, substantial quantities of water 22, as well as unwanted debris, may break loose from the deflecting forces induced by the arcuate surface 18, causing water 22 to spill free of the gutter 12 without being caught by it. Without intending to be bound by any theory, it is believed that this occurs when the kinetic forces acting on the water are sufficient to overcome the surface tension, as a result of which the surface tension is inadequate to deflect the water into a reversing path and into the gutter 12. Such kinetic forces may so become excessive through any or a combination of a number of causes. Included among them are a steep slope of the roof 15 and or the main section 16 by which gravity induced forces become excessive, a high volume of water by which the total force becomes excessive; and "rivuletting" by which the thickness of the sheet of water traversing the device is not uniform but, instead, accumulates into more or less discrete streams with dry voids inbetween, so that excessive volumes of water are localized intermittantly across the face of the device 10 with consequent excessive forces in the rivulet areas sufficient to cause the water stream to break away at one or more places. One way, it was thought, that this adverse result might be remedied, is by increasing the radius of the arcuate portion. However, this induces other difficulties. For example, lowering the gutter to accomodate the consequent lowering of the bottom edge of the deflector is time consuming, difficult, expensive, and disruptive of the aesthetics of the building. These factors, in which the lack of acceptance and use of such devices may lie, are avoided through practice of the present invention.

Figure 3:
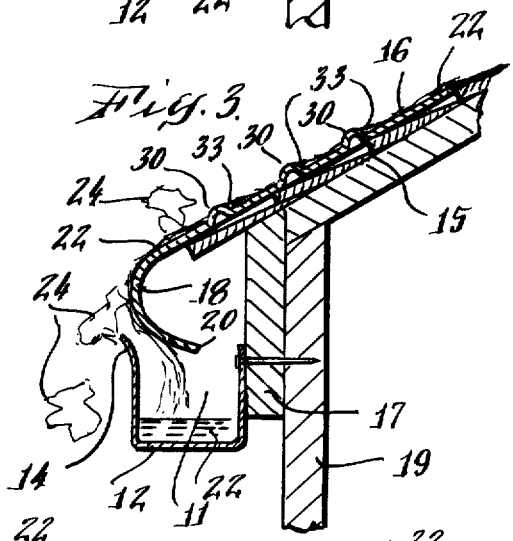
FIG. 3 is a cross-sectional view of an embodiment of the present invention.
Figure 8:
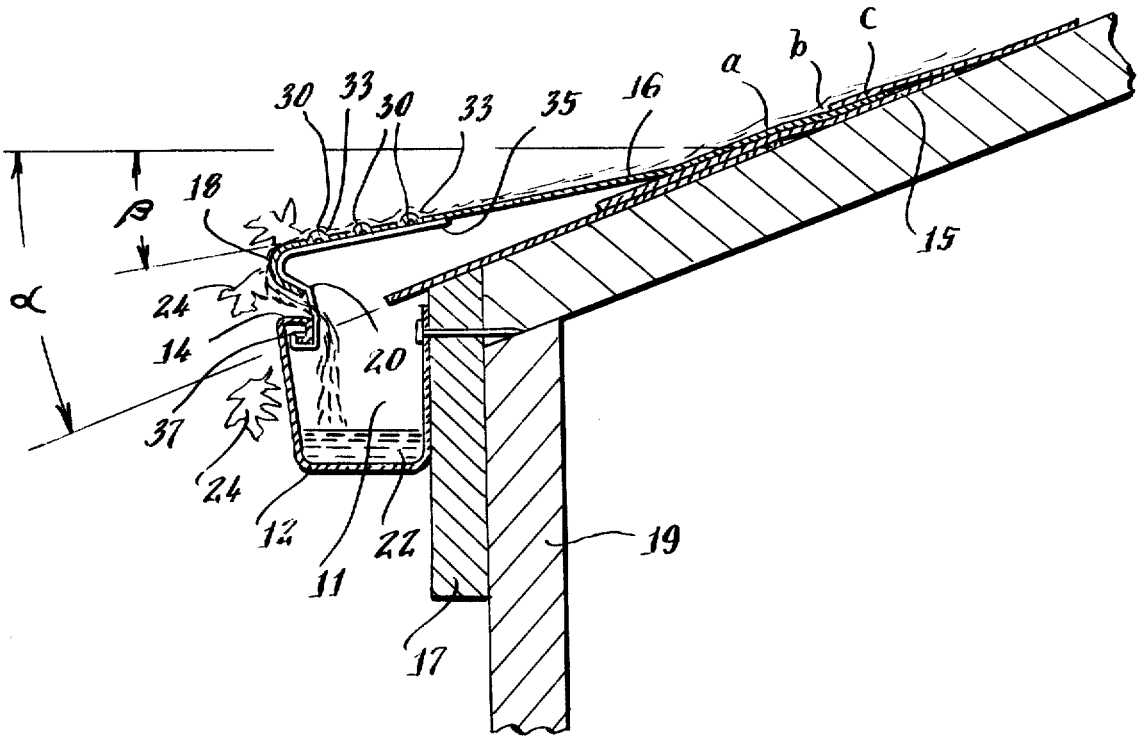
FIG. 8 illustrates an embodiment of this invention.
Figure 9:
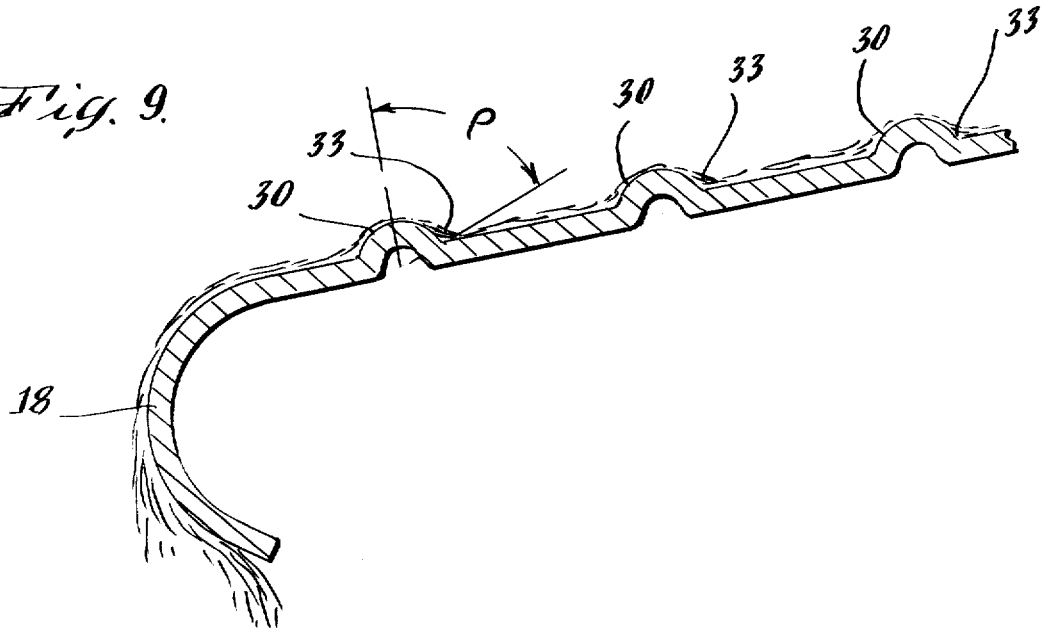
FIG. 9 illustrates details of an embodiment of this invention.

FIGS. 3 and 8 illustrate embodiments of the present invention. Each includes a main body 16, a curved portion 18, and a lower edge 20, and is positioned with respect to an associated gutter 12 so that its arcuate section 18 is outside the trough 11 and the lower edge 20 is between the front and back walls of the gutter 12. Unlike prior art devices, however, these embodiments of this invention include ridges 30, arrayed substantially parallel to the axis of the arcuate portion 18. Three ribs are shown. Although it is within the contemplation of this invention that any number of such ribs may be used, it has been found that a single such rib is of minimal effectiveness for the purposes herein described, that two work well, and that excellent results are obtained with three or more. Generally speaking, it may be postulated that the number of ribs should be increased correspondingly to increases in the maximum quantity of water it is desired to accomodate, particularly where, through the operation of such material as an oil film, the surface wetting characteristics are more or less inhibited. It will be clear that such ribs may easily be incorporated into the sheet metal, plastic or other material from which the device 10 is made by initial casting, rolling, including them as an added part of the cross-section, or other known per se means, and that usually the ribs will have the added feature of strengthening the device against deflection in the longitudinal direction. As will be apparent from FIGS. 3, 8 and 9, the effect of the ribs 30 is to form longitudinal weirs and ponds 33 down the length of the device. As a result, water traversing the device has its velocity interrupted as it collides with the upper surfaces of the ribs and is distributed more or less uniformly across the face of the device. This effect is further enhanced when a second rib is added, and more so with a third. Past a certain number, further enhancement may occur in decreasing amount but not significantly so. In practice, it has been found advantageous to have the plane of the top surface of the deflector intersected by the upstream surface of the uppermost ridge at least (and preferably the other ribs as well) at a pronounced angle, rather than a gentle slope. This causes water moving across the deflector to be confronted by a relatively abrupt barrier at each such intersection, rather than a ramp over which the moving water will shoot, instead of cascading substantially evenly after having first collided with the rib and become more or less co-mingled with the pool of water formed above the ridge. This is emphasized in FIG. 9 where the intersection angle $\rho$ is shown to be steep; i.e. in the range of 55°–85°. Obviously, the intersection angle may be made greater for ribs of semi-circular cross-section by raising the center, or shallower by lowering it. Further, other cross-sectional shapes may be utilized to exploit the phenomenon more effectively. For example, sectors of ellipses can be made to combine lower crowns of the ribs with steeper top and bottom intersections than circular cross-sections, while tear drop shapes can produce regulated crown heights with abrupt "up-stream" intersections while having tapered or shallow sloped "down-stream" intersections. It should also be clear that the upper surfaces of the ribs need not necessarily be arcuate in cross-section. For example, ribs which are merely linear, are quadrilateral, or are "saw-tooth" in cross-section will also function effectively.

As this implies, the height of the crown, or top-most point on the rib with respect to the plane of the upper deflector surface, can also have an affect on achieving the desired "pooling" and cascading attenuation, rather than overshooting with consequent rivuletting and disruption of the desired surface tension phenomenon. These parameters may be individually or collectively manipulated by those skilled in the cognizant arts in light of the particular roof slope-angle, deflector angle, anticipated water flow volume and other determinative factors.

Figure 4:
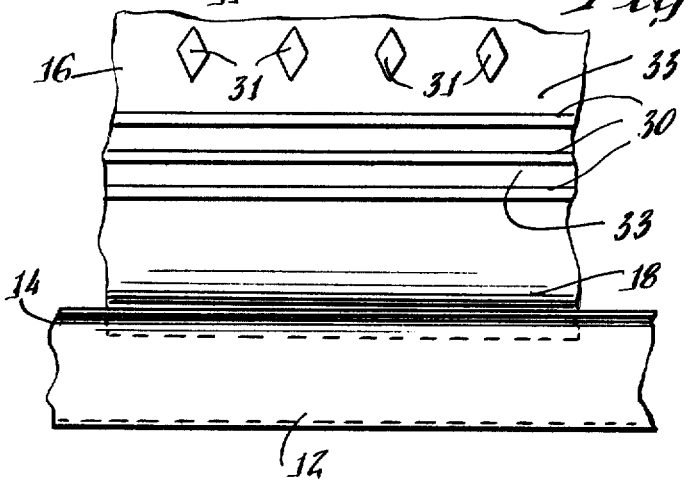
FIG. 4 is a plan view of the embodiment of this invention illustrated in FIG. 3, FIG. 5*a* through 5*d* illustrate various geometric patterns of embodiments of this invention.

The effectiveness of such ribs may also be enhanced by having the lowest (i.e., most "down-stream") of them in close proximity to the top of the curved portion, since this gives the water less opportunity to accelerate beyond desired limits after passing over the lowest rib. It has been found advantageous in certain installations for this spacing to be about 1½ inches. The effect of such velocity attenuations and lateral re-distributions is to reduce the kinetic forces which tend to cause water traversing the device to break free in the course of traversing the arcuate portion 18 of the device, thereby permitting the surface tension forces to dominate the behavior of the water and to cause the water to follow the device around and into the gutter 12; all as shown in FIGS. 3 and 4. They also tend to break up "rivuletting". Note particularly that with the present invention, a smaller radius arcuate section 18 and/or positioning the deflector so that its upper flat surface is at a shallower angle than that of the roof surface, as hereinafter described, can obviate the necessity of relocating the gutter lower on the fascia board, particularly in "retrofit" installations.

Optionally, raised crowns 31 may be formed on the top surface of the main body 16, more or less throughout, or in isolated areas to hold leaves and debris up away from the principal water paths. This has the effect of keeping the water paths unblocked and of making leaves particularly easier to remove because they are less likely to stick down than on a flat surface. Such crowns may be of any suitable geometric shape in plan view, such as squares, circles, ellipses, trapezoids, and the like. Such crowns, which also facilitate removal of debris by the wind by keeping the debris raised above the deflector, may also or alternatively be positioned between the ribs hereinbefore described.

Figure 5:
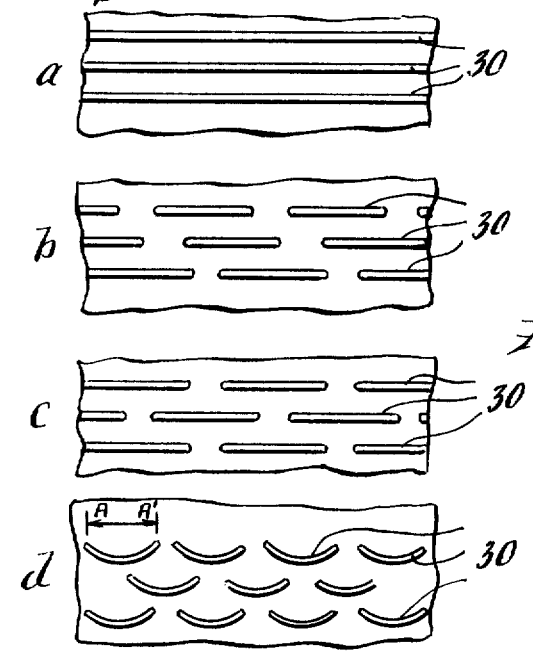

The embodiments illustrated in FIGS. 3, 4 and 8 are shown as having a plurality of continuous ribs 30. Although this is a desired configuration, as shown in FIG. 5, other configurations, such as the continuous and intermittent patterns shown in 5*a*, 5*b*, 5*c*, and 5*d*, may also be effectively used. Further, although linear ribbings are shown, they may be in other forms, such as broader bands, depressions, or other geometric configurations which will produce the desired barrier and/or redistribution effects. Note particularly that as shown in FIG. 5*d*, it is also within the contemplation of this invention that a multiplicity of staggered arcuate ribs might also be used. In this connection, the reference herein to the "long dimension" of such an arcuate rib means the general orientation indicated by a fictitious line joining its ends a-a$^1$.

Figure 6:
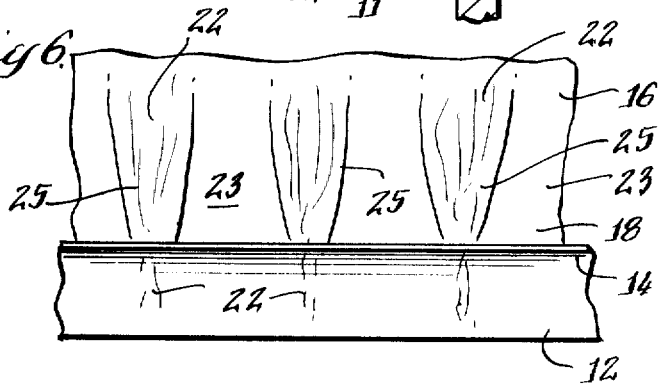
FIG. 6 is a side elevation view of a rain deflector device.

FIG. 6 illustrates the previously referred to "rivuletting" phenomenon. Here, because of uneven distribution of the water and/or incapacity for ready and uniform "wetting" of the surface of the device, the water 22 tends to concentrate in some areas 25, while being less concentrated, thinner, or even totally lacking in other areas 23. As a result, the concentrations of mass in the increased volume areas 25, reacting to the pull of gravity, may set up kinetic forces in the areas of concentration in excess of the surface tension forces, causing water not to follow the contour of the arcuate portion 18 of the device but rather to spill over the outside of the front wall of the gutter 12.

Figure 7:
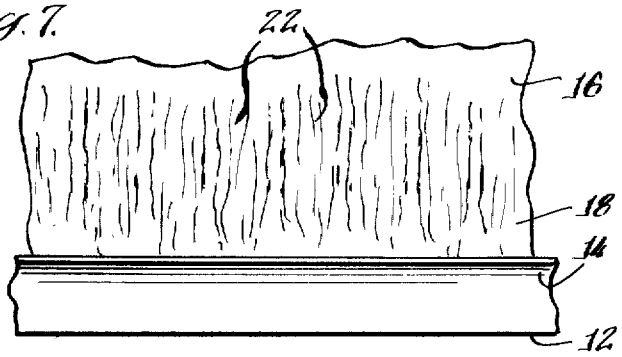
FIG. 7 is a side elevation view of another embodiment of this invention.

As shown in FIG. 7, this "rivuletting" effect may be controlled within tolerable limits or even eliminated by improving the "sheeting" of the water or otherwise rendering it so that it is substantially of uniform thickness across the face of the device. This is analagous to the lateral redistribution effect of the ribs 30 shown in FIGS. 3, 4, and 5, but may be produced by other means. One such means is in the choice of finish applied to the exposed upper surface of the device. For example, acrylic-latex paints generally are very wettable, while surfaces painted with certain polyester based paints are not. The latter, tending to exhibit a much greater tendency to "rivuletting" of the type shown in FIG. 6 than the former, therefore exhibit a greater tendency to "spillover" with devices of the type herein discussed than do the former. The more unified "sheeting" of the water 22 attainable through utilization of "wettable" surfaces is illustrated in FIG. 7 where a sheet of water 22 is shown to have traversed the main portion 16 and to have followed the arcuate contour 18 into the gutter 12. Such surface treatment may be used alone or in combination with the aforementioned ribs and/or other flow interruption devices.

As shown in FIG. 8, devices made in accordance with this invention may be affixed to the eave of a building in appropriate relationship to an associated rain gutter according to known per se means. The upper end of the main portion may be slid under a course of shingles or affixed thereto, or even merely placed in contact with the upper surface thereof as shown in FIG. 3, since, even if there is water leakage between its lower surface and the upper surface of the shingles, debris is not thereby admitted to the gutter and the roof continues to pass water to the gutter merely in the fashion that it was originally intended to do. An additional advantage of such devices is that they also facilitate avoiding the accumulation of ice and or snow at the roof edge both because they present a relatively smooth, adhesionless surface to such materials, and because they cover the gutters themselves which otherwise present "pockets" in which such ice or snow may deposit. It should be noted in particular that devices made in accordance with this invention will function effectively whether the underside of the upper region is substantially flush throughout with the upper surface of the associated roof as shown in FIG. 3, or whether there is an angular displacement therebetween as shown in FIG. 8. Furthermore, in practice, it has been found that it doesn't matter significantly even if the upper edge of devices made in accordance with this invention are not overlayed by a course of shingles since, in any event, the upper edge region will be more or less tight to the upper surface of the roof anyway, and any leakage of water at that point will filter out the significant portion of debris and the water so leaking will merely be handled by the lower edge of the roof and into the associated gutter, functioning entirely in the manner for which they were intended and constructed. In fact, advantages may be realized by positioning the deflector device at a more shallow angle (i.e., more nearly horizontal) than that of the plane of the roof as shown in FIG. 8 since, as will be apparent from the foregoing explanations, this will have the effect, beneficial in terms of operability of the arcuate portion as a debris-water segregator, of reducing the gravity-induced kinetic energy of water coming off the roof and of being aesthetically more pleasing. FIG. 8 also illustrates that it is not necessary to relocate the gutter 12 downward from the location in which traditionally it is placed; i.e., high up on the facia board 17 with its back wall under the overhang of the roof shingles. With the deflector at a shallower angle "$\beta$" than the angle "$\alpha$" of the slope of the roof (with respect to horizontal), the curved portion 18 of the deflector may be of comparatively large radius, thus enhancing the effectiveness of the surface tension phenomenon. By this means, not only is considerable bother and expense avoided in retro-fitting an existing installation, but the final result in a new or retro-fit installation looks better and does not derogate materially from the appearance of the structure as a whole.

It should be noted that the embodiment shown in FIG. 3, where the uppermost edge of the top section of the deflector is not positioned under a course of shingles, may also be oriented at an angle shallower than that of the roof, by raising its curved portion and causing the entire structure to raise upward as it pivots along its upper edge. It has been found advantageous to adapt the upper edge region of deflectors embodying this invention for substantially continuous contact with the upper surface of the roof. This may be done by a variety of means, such as inserting the upper edge region as shown at "c" in FIG. 8, or simply having the upper edge rest on the roof as shown in FIG. 3 with the upper edge region of the deflector having some downward bias to hold it in contact with the roof, or with a strip of tape bridging the top edge region and the top of the roof, or with nails, adhesives, asphalt "spots" or other known per se means. Thus, the top region might be made to end with its top edge abutting the lower edge of a course of shingles, (shown as position "b" in FIG. 8), or with it ending (as shown at position "a" in FIG. 8) partway along the top surface of a shingle so as to afford a flat surface contiguous with the top of the roof, or with its top edge in "line" contact with the top of the roof.

As previously noted, substantial continuity is sufficient, since some water leakage under the deflector is usually of no significant moment to the utilization of such embodiments of this invention. If it is desired, however, as where the debris to be excluded from the gutter includes materials which are smaller than the gap between the deflector and the roof, the interface may be substantially totally sealed off. To enhance such continuity, particularly with the use of adhesives, it may be desirable to introduce an angulation to bring the top region into planar abuttment with the top surface of the roof while the mid-region of the deflector is at a comparatively shallower angle, all as shown in FIG. 8, but this is not critical to operability of this invention.

FIG. 8 also illustrates a support hanger 35 which is particularly adapted for such shallower angle deflectors when used with metal gutters of current design. The hanger may be made from any suitable material, such as metal or plastic, and may be fastened to the deflector by any of a number of known per se fastening means such as sheet metal screws, clips, rivets, welds or brazes, bolts and nuts, adhesives, or the like. As shown, it does not extend all the way along the underside of the top portion of the deflector to the roof, but it may do so and thus provide some added support. The outermost end 37 of the support 35 is formed in a "V" shape at the end of a horizontal span. Thus, the "V" shape may be inserted inside the closure forming the lip 14 of the gutter while the support is attached to the deflector and the deflector is oriented more or less vertical. The support-deflector combination may then be swung pivotally downward to position atop the roof. This hanger provides a structurally simple, effective, and inexpensive support means which is also adapted for facilitating maintenance.

Example

An embodiment of the present invention utilizing a deflector of design substantially like the deflectors shown in FIGS. 3 and 8 was installed at an angle of about 11° on a residence in Raleigh, N.C., the roof of which is at about 22½°. The deflector was made from 0.019" aluminum with a painted finish. The length of the curve through the curved portion was about 2½" and the length of the rest from the curved portion to the topmost edge was about 9½". The radius of the curved portion was about ¾". It had, each 0.15" high and 0.175" wide at the base, of arcuate cross section. The ridges were spaced about 1½ apart, with the bottom-most ridge about 1⅜" back from the top of the curved section. The device was found to work well, delivering virtually all of the water and virtually none of the debris crossing it to the associated gutter throughout the rainy seasons, sometimes during rainstorms which were considered heavy for the region.

Variants of the present invention may include modifications to accomodate the particular roof slope, edge contours and configurations, and/or building materials which characterize any specific structure. Additionally, local or regional climatic conditions may also be accomodated. For example, the National Weather Service publishes various data showing the maximum amounts of rainfall which occur for a range of time intervals (e.g., 5 minutes, 15 minutes, 60 minutes, etc.) over several spans of time (e.g., 2 years, 100 years, etc.). Data such as these may be utilized in varying the exact design configuration of a given deflector, for example, as to the number, nature, configurations, and/or dimensions and comparative proportions of the various elements, the radius and cross-sectional configuration of the curved portion, the surface textures and/or wetability, the angular disposition of the various elements with respect to each other and to the roof, etc., all as will be apparent to those ordinarily skilled in the cognizant arts in view of the present invention. Additionally, a wide variety of materials may be utilized to produce devices according to the present invention. Galvanized steel, aluminum, and other metals, as well as various plastics may also be used to particular advantage since they are easily formed according to technology which is known per se into complex and intricate shapes and configurations, are durable and weather resistant with minimum maintenance requirements, and may be made inherently to have desired surface characteristics such as improved wettability. All of the foregoing are within the skills, competence and knowledge of the person with ordinary skills in the cognizant arts.

Accordingly, it is to be understood that the embodiments of this invention herein described are by way of illustration and not of limitation, and that a wide variety of embodiments may be made without departing from the spirit or scope of this invention.

I claim:

1. A roof on a structure and a water control device for use in association with a gutter which is positioned at the edge of said roof and forms a trough described by an elongated bottom, a rear wall extending upward from said bottom along the side thereof closest to said structure, and a front wall extending upward from said bottom along the side thereof farthest from said structure, which device comprises a continuous main body that has an upper edge region and has a lower region that is substantially arcuate in cross-section, and is adapted for affixation at the edge region of said roof with the axis described by the arcuate portion of said lower region substantially parallel to the long axis of said gutter, with said arcuate portion extending beyond the front wall of said gutter, and with the lowest portion of said region positioned above the trough formed by the front wall, bottom and rear wall of said gutter, said device being mounted on the upper surface of said roof with a portion at least of the under-surface of the part thereof which is first encountered by water traversing said roof in substantially continuous contact with said upper surface of said roof, and said device including flow governing means for causing the kinetic energy of water traversing said device to be less, substantially entirely throughout the region of said arcuate section, than the forces acting counterdirectionally thereto induced by the surface tension of said water, whereby said water will be caused substantially entirely to follow the contour of the upper surface of said arcuate portion of said lower region into said gutter, while debris associated with said water is substantially jettisoned off of said device without passing into said gutter.

2. The device described in claim 1 wherein said flow governing means comprises means for interrupting the flow of said water.

3. The device described in claim 2 wherein said flow governing means comprises at least one elongated elevation in the upper surface of said main body, the long dimension of which extends substantially in the direction of the axis of said arcuate section.

4. The device described in claim 3 wherein said elevation comprises a rib.

5. The device described in claim 3 wherein said flow governing means comprises at least two such elongated elevations.

6. The device described in claim 5 wherein each of said elevations comprises a rib.

7. The device described in claim 3 wherein said governing means comprises three ribs.

8. The device described in any of claims 2, 3, 4, 5, 6, or 7, wherein said flow governing means comprises at least one elongated elevation which is a substantially uninterrupted continuum.

9. The device described in any of claims 2, 3, 4, 5, 6, or 7, wherein said flow governing means comprises at least one tandem array of elongated elevations which collectively form an interrupted continuum.

10. The device described in any of claims 1, 2, 3, 4, 5, 6, or 7, wherein said flow governing means includes a wettable upper surface.

11. The device described in any of claims 2, 3, 4, 5, 6, or 7, wherein said flow governing means comprises at least one elongated elevation which is a substantially uninterrupted continuum, and includes a wettable upper surface.

12. The device described in any of claims 2, 3, 4, 5, 6, or 7, wherein said flow governing means comprises at least one tandem array of elongated elevations which collectively form an interrupted continuum, and includes a wettable upper surface.

13. The device described in any of claims 1, 2, 3, 4, 5, 6, or 7, including at least one crown on the upper edge region.

14. The device described in any of claims 2, 3, 4, 5, 6, or 7, wherein said flow governing means comprises at least one elongated elevation which is a substantially uninterrupted continuum, including at least one crown on the upper edge region.

15. The device described in any of claims 2, 3, 4, 5, 6, or 7, wherein said flow governing means comprises at least one tandem array of elongated elevations which collectively form an interrupted continuum, including at least one crown on the upper edge region.

16. The device described in claim 1 wherein said flow governing means is a wettable upper surface, including at least one crown on the upper edge region.

17. The device described in any of claims 1, 2, 3, 4, 5, 6, or 7, wherein said flow governing means includes a wettable upper surface, including at least one crown on the upper edge region.

18. The device described in any of claims 2, 3, 4, 5, 6, or 7, wherein said flow governing means comprises at least one elongated elevation which is a substantially uninterrupted continuum, and includes a wettable upper surface, including at least one crown on the upper edge region.

19. The device described in any of claims 2, 3, 4, 5, 6, or 7, wherein said flow governing means comprises at least one tandem array of elongated elevations which collectively form an interrupted continuum, and includes a wettable upper surface, including at least one crown on the upper edge region.

20. Rain water control apparatus comprising a roof on a structure, a rain water gutter which forms a trough described by an elongated bottom, a rear wall extending upward from said bottom along the side thereof closest to said structure, and a front wall extending upward from said bottom along the side thereof farthest from said structure, and a rain water deflector, said deflection having a continuous main body that has an upper edge region and a lower region that is substantially arcuate in cross-section, and being adapted for affixation at the edge of said roof with the axis described by the arcuate portion of said lower region substantially parallel to the long axis of said gutter, with said arcuate portion extending beyond the front wall of said gutter, and with the lowest portion of said lower region positioned above the trough formed by the front wall, bottom and rear wall of said gutter, said device being mounted on the upper surface of said roof with a portion at least of the under-surface of the part thereof which is first encountered by water traversing said roof in substantially continuous contract with said upper surface of said roof, and said device including flow governing means for causing the kinetic energy of water traversing said device to be less, substantially entirely throughout the region of said arcuate section, than the forces acting counterdirectionally thereto induced by the surface tension of said water, whereby said water will be caused substantially entirely to follow the contour of the upper surface of said arcuate portion of said lower region into said gutter, while debris associated with said water is substantially entirely jettisoned off of said device without passing into said gutter.

21. The apparatus described in claim 20 wherein said flow governing means comprises a wettable upper surface.

22. The device described in claim 20 wherein said flow governing means comprises a plurality of longitudinally oriented ribs adapted for interrupting the flow of water coming from said roof.

23. The apparatus described in claim 20 wherein said flow governing means comprises a wettable upper surface and a plurality of longitudinally oriented ribs adapted for interrupting the flow of water coming from said roof.

24. Apparatus in accordance with any of claims 20, 21, 22, or 23 wherein said upper edge region of said deflector is more nearly horizontal than is said upper surface of said roof.

25. A method of re-directing the flow of rain water from a roof into a rain gutter positioned along the edge of said roof comprising the steps of reducing the kinetic energy produced by water falling from said roof to within a prescribed upper limit by causing said water to flow across a wettable surface, to distribute the water mass more uniformly, and causing said water to traverse a curved surface into said gutter, which surface extends beyond the outer edge of said gutter and terminates above the trough of said gutter, said limit being prescribed by being less than the surface tension on said water acting counterdirectionally thereto as it traverses through said curved surface.

26. The method described in claim 25 wherein said step of reducing the kinetic energy of said water comprises interrupting the flow of said water and causing said water to flow across a wettable surface.

27. A water control device for use in association with a gutter which is positioned at the edge of the roof of a structure and forms a trough described by an elongated bottom, a rear wall extending upward from said bottom along the side thereof closest to said structure, and a front wall extending upward from said bottom along the side thereof farthest from said structure, which device comprises a continous main body that has an upper edge region and has a lower region that is substantially arcuate in cross-section, and is adapted for affixation at the edge of said roof with the axis described by the arcuate portion of said lower region substantially parallel to the long axis of said gutter, with said arcuate portion extending beyond the front wall of said gutter, and with the lowest portion of said region positioned above the trough formed by the front wall, bottom and rear wall of said gutter, said upper edge region being adapted for mounting on the upper surface of said roof with a portion at least of the under-surface of the part thereof which is first encountered by water traversing said roof in substantially continuous contact with said upper surface of said roof, and said device including flow governing means for causing the kinetic energy of water traversing said device to be less, substantially entirely throughout the region of said arcuate section, than the forces acting counterdirectionally thereto induced by the surface tension of said water, wherein said flow governing means is a wettable upper surface, whereby said water will be caused substantially entirely to follow the contour of the upper surface of said arcuate portion of said lower region into said gutter, while debris associated with said water is substantially jettisoned off of said device without passing into said gutter.

28. The device described in claim 27 wherein said flow governing means includes interruption means for interrupting the flow of said water.

29. The device described in claim 28 wherein said interruption means is at least one elongated elevation in the upper surface of said main body, the long dimension of which extends substantially in the direction of the axis of said arcuate section.

30. The device described in claim 28 wherein said elevation is a rib.

31. The device described in claim 29 wherein said interruption means comprises at least two such elongated elevations.

32. The device described in claim 31 wherein each of said elevations is a rib.

33. The device described in claim 29 wherein said interruption means comprises three ribs.

34. The device described in any of claims 28, 29, 30, 31, 32, or 33 wherein said interruption means comprises at least one elongated elevation which is a substantially uninterrupted continuum.

35. The device described in any of claims 28, 29, 30, 31, 32, or 33 wherein said interruption means comprises at least one tandem array of elongated elevations which collectively form an interrupted continuum.

36. The device described in any of claims 27, 28, 29, 30, 31, 32, or 33 including at least one crown on the upper edge region.

37. The device described in any of claims 27, 28, 29, 30, 31, 32, or 33 wherein said interruption means comprises at least one elongated elevation which is a substantially uninterrupted continuum, including at least one crown on the upper edge region.

38. The device described in any of claims 27, 28, 29, 30, 31, 32, or 33 wherein said interruption means comprises at least one tandem array of elongated elevations which collectively form an interrupted continuum, including at least one crown on the upper edge region.

39. Rain water control apparatus for use at the lower edge of a roof on a structure comprising a rain water gutter which forms a trough described by an elongated bottom, a rear wall extending upward from said bottom along the side thereof closest to said structure, and a front wall extending upward from said bottom along the side thereof farthest from said structure, and a rain water deflector, said deflector having a continuous main body that has an upper edge region and a lower region that is substantially arcuate in cross-section, and being adapted for affixation at the edge of said roof with the axis described by the arcuate portion of said lower region substantially parallel to the long axis of said gutter, with said arcuate portion extending beyond the front wall of said gutter, and with the lowest portion of said lower region positioned above the trough formed by the front wall, bottom and rear wall of said gutter, said upper edge region being adapted for mounting on the upper surface of said roof with a portion at least of the under-surface of the part thereof which is first encountered by water traversing said roof in substantially continuous contact with said upper surface of said roof, and said device including flow governing means comprising a wettable upper surface for causing the kinetic energy of water traversing said device to be less, substantially entirely throughout the region of said arcuate section, than the forces acting counterdirectionally thereto induced by the surface tension of said water, whereby said water will be caused substantially entirely to follow the contour of the upper surface of said arcuate portion of said lower region into said gutter, while debris associated with said water is substantially entirely jettisoned off of said device without passing into said gutter.

40. The device described in claim 39 wherein said flow governing means includes a plurality of longitudinally oriented ribs adapted for interrupting the flow of water coming from said roof.

41. Apparatus in accordance with either of claims 39 or 40 in combination with a sloped roof having an upper surface wherein said upper edge region of said deflector is more nearly horizontal than is said upper surface of said roof.

* * * * *